US009570799B2

(12) United States Patent
Shtrom et al.

(10) Patent No.: US 9,570,799 B2
(45) Date of Patent: Feb. 14, 2017

(54) MULTIBAND MONOPOLE ANTENNA APPARATUS WITH GROUND PLANE APERTURE

(75) Inventors: Victor Shtrom, Los Altos, CA (US); Bernard Baron, Mountain View, CA (US); Chia-Ching Lin, San Jose, CA (US)

(73) Assignee: RUCKUS WIRELESS, INC., Sunnyvale, CA (US)

( * ) Notice: Subject to any disclaimer, the term of this patent is extended or adjusted under 35 U.S.C. 154(b) by 299 days.

(21) Appl. No.: 13/607,612

(22) Filed: Sep. 7, 2012

(65) Prior Publication Data

US 2014/0071013 A1 Mar. 13, 2014

(51) Int. Cl.
*H01Q 3/44* (2006.01)
*H01Q 1/48* (2006.01)
(Continued)

(52) U.S. Cl.
CPC ..... *H01Q 1/48* (2013.01); *H01Q 3/446* (2013.01); *H01Q 5/28* (2015.01); *H01Q 9/32* (2013.01)

(58) Field of Classification Search
CPC .... H01Q 25/00; H01Q 25/002; H01Q 25/005; H01Q 19/005; H01Q 19/32; H01Q 21/29; H01Q 21/293; H01Q 3/2629; H01Q 3/2635; H01Q 3/2641; H01Q 3/446; H01Q 9/30; H01Q 9/32; H01Q 3/005–3/46; H01Q 21/0006–21/30
(Continued)

(56) References Cited

U.S. PATENT DOCUMENTS 723,188 A 3/1903 Tesla
725,605 A 4/1903 Tesla
(Continued)

FOREIGN PATENT DOCUMENTS

CN 1210839 C 7/2005
CN 1 934 750 A 3/2007
(Continued)

OTHER PUBLICATIONS

"Authorization of spread spectrum and other wideband emissions not presently provided for in the FCC Rules and Regulations," Before the Federal Communications Commission, FCC 81-289, 87 F.C.C.2d 876, Jun. 30, 1981.
(Continued)

*Primary Examiner* — Sue A Purvis
*Assistant Examiner* — Patrick Holecek
(74) *Attorney, Agent, or Firm* — Lewis Roca Rothgerber Christie LLP

(57) ABSTRACT

A monopole antenna coupled to a metallic ground plane includes apertures used to steer a radio frequency (RF) beam of the monopole. The apertures may have a length, width, and distance from the monopole based on the wavelength of the RF signal used to drive the monopole antenna. The aperture may be coupled to one or more selective devices, such as PIN diodes, which may short portions of a metallic ground plane near the aperture. The shorted portions of the metallic ground plane provide for steering of the monopole radiation pattern. A circuit board metallic ground plane may include multiple apertures to direct different RF signal frequencies from a single monopole antenna. Multiple monopole antennas may be implemented over a metallic ground plane within a wireless device, each monopole antenna with corresponding apertures.

12 Claims, 6 Drawing Sheets

(51) Int. Cl.
*H01Q 9/32* (2006.01)
*H01Q 5/28* (2015.01)

(58) Field of Classification Search
USPC ..... 343/767, 769, 770, 745; 3/767, 769, 770
See application file for complete search history.

(56) References Cited

U.S. PATENT DOCUMENTS 1,869,659 A 8/1932 Broertjes
2,292,387 A 8/1942 Markey et al.
3,488,445 A 1/1970 Chang
3,568,105 A 3/1971 Felsenheld et al.
3,577,196 A * 5/1971 Pereda ..... 343/770
3,846,799 A * 11/1974 Gueguen ..... 343/833
3,918,059 A 11/1975 Adrian
3,922,685 A 11/1975 Opas
3,967,067 A 6/1976 Potter
3,982,214 A 9/1976 Burns
3,991,273 A 11/1976 Mathes
4,001,734 A 1/1977 Burns
4,145,693 A * 3/1979 Fenwick ..... 343/722
4,176,356 A 11/1979 Foster et al.
4,193,077 A 3/1980 Greenberg et al.
4,253,193 A 2/1981 Kennard
4,305,052 A 12/1981 Baril et al.
4,513,412 A 4/1985 Cox
4,554,554 A 11/1985 Olesen et al.
4,587,524 A 5/1986 Hall
4,733,203 A 3/1988 Ayasli
4,814,777 A 3/1989 Monser
4,845,507 A 7/1989 Archer et al.
4,975,711 A * 12/1990 Lee ..... 343/702
5,063,574 A 11/1991 Moose
5,097,484 A 3/1992 Akaiwa
5,132,698 A 7/1992 Swineford
5,173,711 A 12/1992 Takeuchi et al.
5,203,010 A 4/1993 Felix
5,208,564 A 5/1993 Burns et al.
5,220,340 A 6/1993 Shafai
5,282,222 A 1/1994 Fattouche et al.
5,291,289 A 3/1994 Hulyalkar et al.
5,311,550 A 5/1994 Fouche et al.
5,373,548 A 12/1994 McCarthy
5,507,035 A 4/1996 Bantz
5,532,708 A 7/1996 Krenz et al.
5,559,800 A 9/1996 Mousseau et al.
5,610,617 A 3/1997 Gans et al.
5,629,713 A 5/1997 Mailandt et al.
5,754,145 A 5/1998 Evans
5,767,755 A 6/1998 Kim et al.
5,767,809 A 6/1998 Chuang et al.
5,786,793 A 7/1998 Maeda et al.
5,802,312 A 9/1998 Lazaridis et al.
5,964,830 A 10/1999 Durrett
5,990,838 A 11/1999 Burns et al.
6,006,075 A 12/1999 Smith et al.
6,011,450 A 1/2000 Miya
6,018,644 A 1/2000 Minarik
6,031,503 A 2/2000 Preiss, II et al.
6,034,638 A 3/2000 Thiel et al.
6,052,093 A 4/2000 Yao et al.
6,091,364 A 7/2000 Murakami et al.
6,094,177 A 7/2000 Yamamoto
6,097,347 A 8/2000 Duan et al.
6,101,397 A 8/2000 Grob et al.
6,104,356 A 8/2000 Hikuma et al.
6,166,694 A 12/2000 Ying
6,169,523 B1 1/2001 Ploussios
6,204,825 B1 3/2001 Wilz
6,239,762 B1 5/2001 Lier
6,252,559 B1 6/2001 Donn
6,266,528 B1 7/2001 Farzaneh
6,292,153 B1 9/2001 Aiello et al.
6,307,524 B1 10/2001 Britain
6,317,599 B1 11/2001 Rappaport et al.
6,323,810 B1 11/2001 Poilasne et al.
6,326,922 B1 12/2001 Hegendoerfer
6,337,628 B2 1/2002 Campana et al.
6,337,668 B1 1/2002 Ito et al.
6,339,404 B1 1/2002 Johnson et al.
6,345,043 B1 2/2002 Hsu
6,356,242 B1 3/2002 Ploussios
6,356,243 B1 3/2002 Schneider et al.
6,356,905 B1 3/2002 Gershman et al.
6,377,227 B1 4/2002 Zhu et al.
6,392,610 B1 5/2002 Braun et al.
6,404,386 B1 6/2002 Proctor, Jr. et al.
6,407,719 B1 6/2002 Ohira et al.
RE37,802 E 7/2002 Fattouche et al.
6,414,647 B1 7/2002 Lee
6,424,311 B1 7/2002 Tsai et al.
6,442,507 B1 8/2002 Skimore et al.
6,445,688 B1 9/2002 Garces et al.
6,452,556 B1 9/2002 Ha et al.
6,452,981 B1 9/2002 Raleigh
6,456,242 B1 9/2002 Crawford
6,493,679 B1 12/2002 Rappaport et al.
6,496,083 B1 12/2002 Kushitani et al.
6,498,589 B1 12/2002 Horii
6,499,006 B1 12/2002 Rappaport et al.
6,507,321 B2 1/2003 Oberschmidt et al.
6,531,985 B1 3/2003 Jones et al.
6,583,765 B1 6/2003 Schamberger et al.
6,586,786 B2 7/2003 Kitazawa et al.
6,606,059 B1 8/2003 Barabash
6,611,230 B2 8/2003 Phelan
6,621,464 B1 9/2003 Fang
6,625,454 B1 9/2003 Rappaport et al.
6,633,206 B1 10/2003 Kato
6,642,889 B1 11/2003 McGrath
6,674,459 B2 1/2004 Ben-Shachar et al.
6,701,522 B1 3/2004 Rubin et al.
6,720,925 B2 4/2004 Wong et al.
6,724,346 B2 4/2004 Le Bolzer
6,725,281 B1 4/2004 Zintel et al.
6,741,219 B2 5/2004 Shor
6,747,605 B2 6/2004 Lebaric
6,753,814 B2 6/2004 Killen et al.
6,753,826 B2 * 6/2004 Chiang et al. ..... 343/834
6,762,723 B2 7/2004 Nallo et al.
6,774,846 B2 8/2004 Fullerton et al.
6,779,004 B1 8/2004 Zintel
6,786,769 B2 9/2004 Lai
6,801,790 B2 10/2004 Rudrapatna
6,819,287 B2 11/2004 Sullivan et al.
6,839,038 B2 1/2005 Weinstein
6,859,176 B2 2/2005 Choi
6,859,182 B2 2/2005 Horii
6,876,280 B2 4/2005 Nakano
6,876,836 B2 4/2005 Lin et al.
6,888,504 B2 5/2005 Chiang et al.
6,888,893 B2 5/2005 Li et al.
6,892,230 B1 5/2005 Gu et al.
6,903,686 B2 6/2005 Vance et al.
6,906,678 B2 6/2005 Chen
6,910,068 B2 6/2005 Zintel et al.
6,914,581 B1 7/2005 Popek
6,924,768 B2 8/2005 Wu et al.
6,931,429 B2 8/2005 Gouge et al.
6,937,206 B2 8/2005 Puente Ballarda et al.
6,941,143 B2 9/2005 Mathur
6,943,749 B2 9/2005 Paun
6,946,996 B2 9/2005 Koyama
6,950,019 B2 9/2005 Bellone et al.
6,950,069 B2 9/2005 Gaucher et al.
6,961,026 B2 11/2005 Toda
6,961,028 B2 11/2005 Joy et al.
6,965,353 B2 11/2005 Shirosaka et al.
6,973,622 B1 12/2005 Rappaport et al.
6,975,834 B1 12/2005 Forster
6,980,782 B1 12/2005 Braun et al.
7,023,909 B1 4/2006 Adams et al.
7,034,769 B2 4/2006 Surducan et al.
7,034,770 B2 4/2006 Yang et al.

(56) References Cited

U.S. PATENT DOCUMENTS 7,039,363 B1 5/2006 Kasapi et al.
7,043,277 B1 5/2006 Pfister
7,050,809 B2 5/2006 Lim
7,053,844 B2 5/2006 Gaucher et al.
7,053,845 B1 5/2006 Holloway et al.
7,064,717 B2 6/2006 Kaluzni et al.
7,068,234 B2 6/2006 Sievenpiper
7,075,485 B2 7/2006 Song et al.
7,084,816 B2 * 8/2006 Watanabe ..... 343/700 MS
7,084,823 B2 8/2006 Caimi et al.
7,085,814 B1 8/2006 Ghandhi et al.
7,088,299 B2 8/2006 Siegler et al.
7,089,307 B2 8/2006 Zintel et al.
7,130,895 B2 10/2006 Zintel et al.
7,171,475 B2 1/2007 Weisman et al.
7,193,562 B2 3/2007 Shtrom et al.
7,196,674 B2 3/2007 Timofeev et al.
7,277,063 B2 10/2007 Shirosaka et al.
7,308,047 B2 12/2007 Sadowsky
7,312,762 B2 12/2007 Puente Ballarda et al.
7,319,432 B2 1/2008 Andersson
7,327,328 B2 2/2008 Yoneya et al.
7,362,280 B2 4/2008 Shtrom et al.
7,388,552 B2 * 6/2008 Mori ..... 343/770
7,424,298 B2 9/2008 Lastinger et al.
7,493,143 B2 2/2009 Jalali
7,498,996 B2 3/2009 Shtrom et al.
7,525,486 B2 4/2009 Shtrom et al.
7,603,141 B2 10/2009 Dravida
7,609,223 B2 10/2009 Manasson et al.
7,646,343 B2 1/2010 Shtrom et al.
7,652,632 B2 1/2010 Shtrom et al.
7,675,474 B2 3/2010 Shtrom et al.
7,696,940 B1 4/2010 Macdonald
7,696,943 B2 4/2010 Chiang et al.
7,696,948 B2 4/2010 Abramov et al.
7,868,842 B2 1/2011 Chair
7,880,683 B2 2/2011 Shtrom et al.
7,899,497 B2 3/2011 Kish et al.
7,965,252 B2 6/2011 Shtrom et al.
8,031,129 B2 10/2011 Shtrom et al.
8,199,063 B2 6/2012 Moon et al.
8,314,749 B2 11/2012 Shtrom et al.
8,698,675 B2 4/2014 Shtrom et al.
8,860,629 B2 10/2014 Shtrom et al.
2001/0046848 A1 11/2001 Kenkel
2002/0031130 A1 3/2002 Tsuchiya et al.
2002/0047800 A1 4/2002 Proctor, Jr. et al.
2002/0054580 A1 5/2002 Strich et al.
2002/0080767 A1 6/2002 Lee
2002/0084942 A1 7/2002 Tsai et al.
2002/0101377 A1 8/2002 Crawford
2002/0105471 A1 8/2002 Kojima et al.
2002/0112058 A1 8/2002 Weisman et al.
2002/0140607 A1 10/2002 Zhou
2002/0158798 A1 10/2002 Chiang et al.
2002/0170064 A1 11/2002 Monroe et al.
2003/0026240 A1 2/2003 Eyuboglu et al.
2003/0030588 A1 2/2003 Kalis et al.
2003/0063591 A1 4/2003 Leung et al.
2003/0076264 A1 4/2003 Yuanzhu
2003/0122714 A1 7/2003 Wannagot et al.
2003/0169330 A1 9/2003 Ben-Shachar et al.
2003/0184490 A1 10/2003 Raiman et al.
2003/0189514 A1 10/2003 Miyano et al.
2003/0189521 A1 10/2003 Yamamoto et al.
2003/0189523 A1 10/2003 Ojantakanen et al.
2003/0210207 A1 11/2003 Suh et al.
2003/0227414 A1 12/2003 Saliga et al.
2004/0014432 A1 1/2004 Boyle
2004/0017310 A1 1/2004 Runkle et al.
2004/0017315 A1 1/2004 Fang et al.
2004/0017860 A1 1/2004 Liu
2004/0027291 A1 2/2004 Zhang et al.
2004/0027304 A1 2/2004 Chiang et al.
2004/0032378 A1 2/2004 Volman et al.
2004/0036651 A1 2/2004 Toda
2004/0036654 A1 2/2004 Hsieh
2004/0041732 A1 3/2004 Aikawa et al.
2004/0048593 A1 3/2004 Sano
2004/0058690 A1 3/2004 Ratzel et al.
2004/0061653 A1 4/2004 Webb et al.
2004/0070543 A1 4/2004 Masaki
2004/0075609 A1 4/2004 Li
2004/0080455 A1 4/2004 Lee
2004/0095278 A1 5/2004 Kanemoto et al.
2004/0114535 A1 6/2004 Hoffmann et al.
2004/0125777 A1 7/2004 Doyle et al.
2004/0145528 A1 7/2004 Mukai et al.
2004/0150567 A1 8/2004 Yuanzhu
2004/0160376 A1 8/2004 Hornsby et al.
2004/0183727 A1 9/2004 Choi
2004/0190477 A1 9/2004 Olson et al.
2004/0203347 A1 10/2004 Nguyen
2004/0239571 A1 12/2004 Papziner et al.
2004/0260800 A1 12/2004 Gu et al.
2005/0001777 A1 1/2005 Suganthan et al.
2005/0022210 A1 1/2005 Zintel et al.
2005/0041739 A1 2/2005 Li et al.
2005/0042988 A1 2/2005 Hoek et al.
2005/0048934 A1 3/2005 Rawnick et al.
2005/0074018 A1 4/2005 Zintel et al.
2005/0074108 A1 4/2005 Dezonno et al.
2005/0083236 A1 4/2005 Louzir et al.
2005/0097503 A1 5/2005 Zintel et al.
2005/0105632 A1 5/2005 Catreux-Erces et al.
2005/0128983 A1 6/2005 Kim et al.
2005/0135480 A1 6/2005 Li et al.
2005/0138137 A1 6/2005 Encarnacion et al.
2005/0138193 A1 6/2005 Encarnacion et al.
2005/0146475 A1 7/2005 Bettner et al.
2005/0180381 A1 8/2005 Retzer et al.
2005/0188193 A1 8/2005 Kuehnel et al.
2005/0200529 A1 9/2005 Watanabe
2005/0219128 A1 10/2005 Tan et al.
2005/0240665 A1 10/2005 Gu et al.
2005/0266902 A1 12/2005 Khatri
2005/0267935 A1 12/2005 Ghandhi et al.
2006/0007891 A1 1/2006 Aoki et al.
2006/0038734 A1 2/2006 Shtrom et al.
2006/0050005 A1 3/2006 Shirosaka et al.
2006/0078066 A1 4/2006 Yun
2006/0094371 A1 5/2006 Nguyen
2006/0098607 A1 5/2006 Zeng et al.
2006/0109191 A1 5/2006 Shtrom et al.
2006/0123124 A1 6/2006 Weisman et al.
2006/0123125 A1 6/2006 Weisman et al.
2006/0123455 A1 6/2006 Pai et al.
2006/0160495 A1 7/2006 Strong
2006/0168159 A1 7/2006 Weisman et al.
2006/0184660 A1 8/2006 Rao et al.
2006/0184661 A1 8/2006 Weisman et al.
2006/0184693 A1 8/2006 Rao et al.
2006/0187660 A1 8/2006 Liu
2006/0224690 A1 10/2006 Falkenburg et al.
2006/0225107 A1 10/2006 Seetharaman et al.
2006/0227761 A1 10/2006 Scott, III et al.
2006/0239369 A1 10/2006 Lee
2006/0262015 A1 11/2006 Thornell-Pers et al.
2006/0291434 A1 12/2006 Gu et al.
2007/0027622 A1 2/2007 Cleron et al.
2007/0135167 A1 6/2007 Liu
2007/0162819 A1 7/2007 Kawamoto
2008/0062063 A1 3/2008 Matsushita et al.
2008/0266189 A1 10/2008 Wu et al.
2008/0284657 A1 11/2008 Rudant
2009/0075606 A1 3/2009 Shtrom et al.
2010/0289705 A1 11/2010 Shtrom et al.
2011/0205137 A1 8/2011 Shtrom et al.
2012/0007790 A1 1/2012 Shtrom et al.
2012/0068892 A1 3/2012 Shtrom et al.
2013/0181882 A1 7/2013 Shtrom et al.
2014/0225807 A1 8/2014 Shtrom et al.
2014/0285391 A1 9/2014 Baron

(56) References Cited

U.S. PATENT DOCUMENTS

FOREIGN PATENT DOCUMENTS

| | | | |
|---|---|---|---|
| CN | 102868024 | A | 1/2013 |
| CN | 103201908 | A | 7/2013 |
| CN | ZL 200780020943.9 | | 11/2013 |
| CN | 101473488 | B | 2/2014 |
| EP | 352 787 | | 1/1990 |
| EP | 0 534 612 | | 3/1993 |
| EP | 0 756 381 | | 1/1997 |
| EP | 1 152 452 | | 11/2001 |
| EP | 1 376 920 | | 6/2002 |
| EP | 1 220 461 | | 7/2002 |
| EP | 1 315 311 | | 5/2003 |
| EP | 1 450 521 | | 8/2004 |
| EP | 1 562 259 | A1 | 8/2005 |
| EP | 1 608 108 | | 12/2005 |
| EP | 1 152 453 | | 11/2011 |
| EP | 2 479 837 | | 7/2012 |
| EP | 2 619 848 | | 7/2013 |
| EP | 2 893 593 | | 7/2015 |
| HK | 1180836 | A | 10/2013 |
| JP | 2003-038933 | | 2/1991 |
| JP | 2008-088633 | | 2/1996 |
| JP | 2011-215040 | | 8/1999 |
| JP | 2001-057560 | | 2/2002 |
| JP | 2005-244302 | A | 9/2005 |
| JP | 2005-354249 | | 12/2005 |
| JP | 2006-060408 | | 3/2006 |
| TW | I372487 | | 9/2012 |
| TW | I451624 | | 9/2014 |
| WO | WO 90/04893 | | 5/1990 |
| WO | WO 02/25967 | | 3/2002 |
| WO | WO 03/079484 | | 9/2003 |
| WO | WO 2006/023247 | | 3/2006 |
| WO | WO 2007/127087 | | 11/2007 |
| WO | WO 2007/127088 | | 11/2007 |
| WO | WO 2012/040397 | | 3/2012 |
| WO | WO 2014/039949 | | 3/2014 |
| WO | WO 2014/146038 | | 9/2014 |
| WO | WO 2010/086587 | A1 | 4/2016 |

OTHER PUBLICATIONS

"Authorization of Spread Spectrum Systems Under Parts 15 and 90 of the FCC Rules and Regulations," Rules and Regulations Federal Communications Commission, 47 CFR Part 2, 15, and 90, Jun. 18, 1985.

Alard, M., et al., "Principles of Modulation and Channel Coding for Digital Broadcasting for Mobile Receivers," 8301 EBU Review Technical, Aug. 1987, No. 224, Brussels, Belgium.

Ando et al., "Study of Dual-Polarized Omni-Directional Antennas for 5.2 GHz-Band 2x2 MIMO-OFDM Systems," Antennas and Propogation Society International Symposium, 2004, IEEE, pp. 1740-1743, vol. 2.

Areg Alimian et al., "Analysis of Roaming Techniques," doc.:IEEE 802.11-04/0377r1, Submission, Mar. 2004.

Bedell, Paul "Wireless Crash Course," 2005, p. 84, The McGraw-Hill Companies, Inc., USA.

Behdad et al., Slot Antenna Miniaturization Using Distributed Inductive Loading, Antenna and Propagation Society International Symposium, 2003 IEEE, vol. 1, pp. 308-311 (Jun. 2003).

Berenguer, Inaki, et al., "Adaptive MIMO Antenna Selection," Nov. 2003.

Casas, Eduardo F., et al., "OFDM for Data Communication Over Mobile Radio FM Channels-Part I: Analysis and Experimental Results," IEEE Transactions on Communications, vol. 39, No. 5, May 1991, pp. 783-793.

Casas, Eduardo F., et al., "OFDM for Data Communication Over Mobile Radio FM Channels-Part II: Performance Improvement," Department of Electrical Engineering, University of British Colombia.

Chang, Nicholas B. et al., "Optimal Channel Probing and Transmission Scheduling for Opportunistics Spectrum Access," Sep. 2007.

Chang, Robert W., "Synthesis of Band-Limited Orthogonal Signals for Mutichannel Data Transmission," The Bell System Technical Journal, Dec. 1966, pp. 1775-1796.

Chang, Robert W., et al., "A Theoretical Study of Performance of an Orthogonal Multiplexing Data Transmission Scheme," IEEE Transactions on Communication Technology, vol. Com-16, No. 4, Aug. 1968, pp. 529-540.

Chuang et al., A 2.4 GHz Polarization-diversity Planar Printed Dipole Antenna for WLAN and Wireless Communication Applications, Microwave Journal, vol. 45, No. 6, pp. 50-62 (Jun. 2002).

Cimini, Jr., Leonard J, "Analysis and Simulation of a Digital Mobile Channel Using Orthogonal Frequency Division Multiplexing," IEEE Transactions on Communications, vol. Com-33, No. 7, Jul. 1985, pp. 665-675.

Cisco Systems, "Cisco Aironet Access Point Software Configuration Guide: Configuring Filters and Quality of Service," Aug. 2003.

Dell Inc., "How Much Broadcast and Multicast Traffic Should I Allow in My Network," PowerConnect Application Note #5, Nov. 2003.

Dunkels, Adam et al., "Connecting Wireless Sensornets with TCP/IP Networks," Proc. of the 2d Int'l Conf. on Wired Networks, Frankfurt, Feb. 2004.

Dunkels, Adam et al., "Making TCP/IP Viable for Wireless Sensor Networks," Proc. of the 1st Euro. Workshop on Wireless Sensor Networks, Berlin, Jan. 2004.

Dutta, Ashutosh et al., "MarconiNet Supporting Streaming Media Over Localized Wireless Multicast," Proc. of the 2d Int'l Workshop on Mobile Commerce, 2002.

English Translation of PCT Pub. No. WO2004/051798 (as filed U.S. Appl. No. 10/536,547).

Festag, Andreas, "What is MOMBASA?" Telecommunication Networks Group (TKN), Technical University of Berlin, Mar. 7, 2002.

Frederick et al., Smart Antennas Based on Spatial Multiplexing of Local Elements (SMILE) for Mutual Coupling Reduction, IEEE Transactions of Antennas and Propogation, vol. 52., No. 1, pp. 106-114 (Jan. 2004).

Gaur, Sudhanshu, et al., "Transmit/Receive Antenna Selection for MIMO Systems to Improve Error Performance of Linear Receivers," School of ECE, Georgia Institute of Technology, Apr. 4, 2005.

Gledhill, J. J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.

Golmie, Nada, "Coexistence in Wireless Networks: Challenges and System-Level Solutions in the Unlicensed Bands," Cambridge University Press, 2006.

Hewlett Packard, "HP ProCurve Networking: Enterprise Wireless LAN Networking and Mobility Solutions," 2003.

Hirayama, Koji et al., "Next-Generation Mobile-Access IP Network," Hitachi Review vol. 49, No. 4, 2000.

Ian R. Akyildiz, et al., "A Virtual Topology Based Routing Protocol for Multihop Dynamic Wireless Networks," Broadband and Wireless Networking Lab, School of Electrical and Computer Engineering, Georgia Institute of Technology, no date.

Information Society Technologies Ultrawaves, "System Concept / Architecture Design and Communication Stack Requirement Document," Feb. 23, 2004.

Ken Tang, et al., "MAC Layer Broadcast Support in 802.11 Wireless Networks," Computer Science Department, University of California, Los Angeles, 2000 IEEE, pp. 544-548.

Ken Tang, et al., "MAC Reliable Broadcast in Ad Hoc Networks," Computer Science Department, University of California, Los Angeles, 2001 IEEE, pp. 1008-1013.

Mawa, Rakesh, "Power Control in 3G Systems," Hughes Systique Corporation, Jun. 28, 2006.

Microsoft Corporation, "IEEE 802.11 Networks and Windows XP," Windows Hardware Developer Central, Dec. 4, 2001.

Molisch, Andreas F., et al., "MIMO Systems with Antenna Selection—an Overview," Draft, Dec. 31, 2003.

(56) References Cited

OTHER PUBLICATIONS

Moose, Paul H., "Differential Modulation and Demodulation of Multi-Frequency Digital Communications Signals," 1990 IEEE, CH2831-6/90/0000-0273.
Pat Calhoun et al., "802.11 r strengthens wireless voice," Technology Update, Network World, Aug. 22, 2005, http://www.networkworld.com/news/tech/2005/082208techupdate.html.
Press Release, Netgear RangeMax(TM) Wireless Networking Solutions Incorporate Smart MIMO Technology to Eliminate Wireless Dead Spots and Take Consumers Farther, Ruckus Wireles Inc. (Mar. 7, 2005), available at http://ruckuswireless.com/press/releases/20050307.php.
RL Miller, "4.3 Project X—A True Secrecy System for Speech," Engineering and Science in the Bell System, A History of Engineering and Science in the Bell System National Service in War and Peace (1925-1975), pp. 296-317, 1978, Bell Telephone Laboratories, Inc.
Sadek, Mirette, et al., "Active Antenna Selection in Multiuser MIMO Communications," IEEE Transactions on Signal Processing, vol. 55, No. 4, Apr. 2007, pp. 1498-1510.
Saltzberg, Burton R., "Performance of an Efficient Parallel Data Transmission System," IEEE Transactions on Communication Technology, vol. Com-15, No. 6, Dec. 1967, pp. 805-811.
Steger, Christopher et al., "Performance of IEEE 802.11b Wireless LAN in an Emulated Mobile Channel," 2003.
Toskala, Antti, "Enhancement of Broadcast and Introduction of Multicast Capabilities in RAN," Nokia Networks, Palm Springs, California, Mar. 13-16, 2001.
Tsunekawa, Kouichi "Diversity Antennas for Portable Telephones," 39th IEEE Vehicular Technology, May 1-3, 1989, San Francisco, CA.
Varnes et al., A Switched Radial Divider for an L-Band Mobile Satellite Antenna, European Microwave Conference (Oct. 1995), pp. 1037-1041.
Vincent D. Park, et al., "A Performance Comparison of the Temporally-Ordered Routing Algorithm and Ideal Link-State Routing," IEEE, Jul. 1998, pp. 592-598.
W.E. Doherty, Jr. et al., The Pin Diode Circuit Designer's Handbook 1998.
Weinstein, S. B., et al., "Data Transmission by Frequency-Division Multiplexing Using the Discrete Fourier Transform," IEEE Transactions on Communication Technology, vol. Com-19, No. 5, Oct. 1971, pp. 628-634.
Wennstrom, Mattias et al., "Transmit Antenna Diversity in Ricean Fading MIMO Channels with Co-Channel Interference," 2001.
Petition Decision Denying Request to Order Additional Claims for U.S. Pat. No. 7,193,562 (Control No. 95/001078) mailed on Jul. 10, 2009.
Right of Appeal Notice for U.S. Pat. No. 7,193,562 (Control No. 95/001078) mailed on Jul. 10, 2009.
Supplementary Eurpean Search Report for EP Application No. 07755519 dated Mar. 11, 2009.
PCT/US07/09278, PCT Search Report and Written Opinion mailed Aug. 18, 2008.
PCT/US11/052661, PCT Search Report and Written Opinion mailed Jan. 17, 2012.
Chinese patent application No. 200780023325.X, First Office Action mailed Feb. 13, 2012.
U.S. Appl. No. 11/413,670, Final Office Action mailed Jul. 13, 2009.
U.S. Appl. No. 11/413,670, Office Action mailed Jan. 6, 2009.
U.S. Appl. No. 11/413,670, Final Office Action mailed Aug. 11, 2008.
U.S. Appl. No. 11/413,670, Office Action mailed Feb. 4, 2008.
U.S. Appl. No. 11/414,117, Final Office Action mailed Jul. 6, 2009.
U.S. Appl. No. 11/414,117, Office Action mailed Sep. 25, 2008.
U.S. Appl. No. 11/414,117, Office Action mailed Mar. 21, 2008.
U.S. Appl. No. 12/545,758, Office Action mailed Jan. 2, 2013.
U.S. Appl. No. 12/545,758, Final Office Action mailed Oct. 3, 2012.
U.S. Appl. No. 12/545,758, Office Action mailed Oct. 3, 2012.
U.S. Appl. No. 12/605,256, Office Action mailed Dec. 28, 2010.
U.S. Appl. No. 12/887,448, Office Action mailed Jan. 7, 2013.
U.S. Appl. No. 13/240,687, Office Action mailed Feb. 22, 2012.
PCT/US14/030911, PCT International Search Report and Written Opinion mailed Aug. 22, 2014.
Chinese Patent Application No. 201210330398.6, First Office Action mailed Feb. 20, 2014.
Siemens, Carrier Lifetime and Forward Resistance in RF PIN Diodes. 1997. [retrieved on Dec. 1, 2013]. Retrieved from the Internet: <URL:http://palgong.kyungpook.ac.kr/~ysyoon/Pdf/appli034.pdf>.
Chinese Patent Application No. 200780023325.X, Second Office Action mailed Oct. 19, 2012.
Chinese Patent Application No. 200780020943.9, Second Office Action mailed Aug. 29, 2012.
Taiwan Patent Application No. 096114271, Office Action mailed Dec. 18, 2013.
Taiwan Patent Application No. 096114265, Office Action mailed Jun. 20, 2011.
PCT/US11/052661, PCT Preliminary Report on Patentability mailed Mar. 26, 2013.
PCT/US07/009276, PCT International Search Report and Written Opinion mailed Aug. 11, 2008.
PCT/US13/058713, PCT International Search Report and Written Opinion mailed Dec. 13, 2013.
U.S. Appl. No. 12/545,758, Final Office Action mailed Sep. 10, 2013.
U.S. Appl. No. 12/887,448, Final Office Action mailed Jan. 14, 2014.
U.S. Appl. No. 12/887,448, Office Action mailed Sep. 26, 2013.
U.S. Appl. No. 12/887,448, Final Office Action mailed Jul. 2, 2013.
U.S. Appl. No. 13/681,421, Office Action mailed Dec. 3, 2013.
Chinese Patent Application No. 201180050872.3, First Office Action mailed May 30, 2014.
U.S. Appl. No. 12/887,448, Office Action mailed Apr. 28, 2014.
European Application No. 11827493.5 Extended European Search Report dated Nov. 6, 2014.
European Application No. 7775498.4 Examination Report dated Mar. 12, 2013.
European Application No. 7775498.4 Examination Report dated Oct. 17, 2011.
Chinese Patent Application No. 201210330398.6, Second Office Action mailed Sep. 24, 2014.
U.S. Appl. No. 12/887,448, Final Office Action mailed Feb. 10, 2015.
Chinese Patent Application No. 201180050872.3, Second Office Action mailed Jan. 30, 2015.
Chinese Patent Application No. 201210330398.6, Third Office Action mailed Jun. 2, 2015.
U.S. Appl. No. 14/217,392, Office Action mailed Sep. 16, 2015.
Chinese Patent Application No. 201180050872.3, Third Office Action mailed Aug. 4, 2015.
Chinese Patent Application No. 201210330398.6, Fourth Office Action mailed Sep. 17, 2015.
SIPO Office Action for related Chinese Application No. 201210330398.6, dated Jan. 4, 2016 (12 sheets).
SIPO Notification of Grant for related Chinese Application No. 201180050872.3, dated Jan. 11, 2016 (4 sheets).
Final Office Action for co-pending U.S. Appl. No. 14/217,392, dated Mar. 4, 2016 (17 sheets).
Notice of Allowance for related U.S. Appl. No. 12/887,448, dated Mar. 28, 2016 (9 sheets).
Notice of Allowance for related U.S. Appl. No. 14/252,857, dated Apr. 13, 2016 (8 sheets).
Extended European Search Report for corresponding EP Application No. 13834691.1, dated Apr. 6, 2016 (7 sheets).

* cited by examiner

MULTIBAND MONOPOLE ANTENNA APPARATUS WITH GROUND PLANE APERTURE

BACKGROUND OF THE INVENTION

Field of the Invention

The present invention generally relates to wireless communications. More specifically, the present invention relates to monopole multi frequency antennas.

Description of the Related Art

In wireless communications systems, there is an ever-increasing demand for higher data throughput and reduced interference that can disrupt data communications. A wireless link in an Institute of Electrical and Electronic Engineers (IEEE) 802.11 network may be susceptible to interference from other access points and stations, other radio transmitting devices, and changes or disturbances in the wireless link environment between an access point and remote receiving node. The interference may degrade the wireless link thereby forcing communication at a lower data rate. The interference may, in some instances, be sufficiently strong as to disrupt the wireless link altogether.

FIG. 1 is a block diagram of a wireless device 100 in communication with one or more remote devices and as is generally known in the art. While not shown, the wireless device 100 of FIG. 1 includes antenna elements and a radio frequency (RF) transmitter and/or a receiver, which may operate using the 802.11 protocol. The wireless device 100 of FIG. 1 may be encompassed in a set-top box, a laptop computer, a television, a Personal Computer Memory Card International Association (PCMCIA) card, a remote control, a mobile telephone or smart phone, a handheld gaming device, a remote terminal, or other mobile device.

In one particular example, the wireless device 100 may be a handheld device that receives input through an input mechanism configured to be used by a user. The wireless device 100 may process the input and generate a corresponding RF signal, as may be appropriate. The generated RF signal may then be transmitted to one or more receiving nodes 110-140 via wireless links. Nodes 120-140 may receive data, transmit data, or transmit and receive data (i.e., a transceiver).

Wireless device 100 may also be an access point for communicating with one or more remote receiving nodes over a wireless link as might occur in an 802.11 wireless network. The wireless device 100 may receive data as a part of a data signal from a router connected to the Internet (not shown) or a wired network. The wireless device 100 may then convert and wirelessly transmit the data to one or more remote receiving nodes (e.g., receiving nodes 110-140). The wireless device 100 may also receive a wireless transmission of data from one or more of nodes 110-140, convert the received data, and allow for transmission of that converted data over the Internet via the aforementioned router or some other wired device. The wireless device 100 may also form a part of a wireless local area network (LAN) that allows for communications among two or more of nodes 110-140.

For example, node 110 may be a mobile device with Wi-Fi capability. Node 110 (mobile device) may communicate with node 120, which may be a laptop computer including a Wi-Fi card or wireless chipset. Communications by and between node 110 and node 120 may be routed through the wireless device 100, which creates the wireless LAN environment through the emission of RF and 802.11 compliant signals.

Efficient design of wireless device 100 is important to provide a competitive product in the market place. It is important to provide a wireless device 100 with a small footprint that can be utilized in different environments. Wireless device 100 may have dipole antenna elements built into the circuit board or manually mounted to the wireless device. When mounted manually, matching antenna elements are attached to opposing surfaces of the circuit board and typically soldered although those elements may be attached by other means.

A monopole antenna includes only a single radiating element and is coupled to a ground plane of a transmitter. The monopole radiation reflects from the ground plane to provide radiation in a dipole antenna radiation pattern. Dipole antenna elements may provide beam steering RF signals but are more costly to manufacture than monopole antennas. There is a need for an improved beam steering antenna apparatus for use in wireless devices.

SUMMARY OF THE PRESENTLY CLAIMED INVENTION

A monopole antenna is coupled to a ground plane, such as a metallic ground plane, that includes apertures used to steer a radio frequency (RF) beam of the monopole. The apertures may have a length, width, and distance from the monopole based on the wavelength of the RF signal used to drive the monopole antenna. The aperture may be in any of several shapes and patterns, including circular, square, and other patterns about the footprint of the antenna on a circuit board. One or more radio frequency switches, such as PIN diodes, may selectively provide a short circuit at a portion of the ground plane near the aperture. The portions of the ground plane near the aperture and at which a short circuit is generated provide for steering of the monopole radiation pattern. A circuit board ground plane may include multiple apertures to direct different RF signal frequencies from a single monopole antenna. Multiple monopole antennas may be implemented over a ground plane within a wireless device, each monopole antenna with corresponding apertures. Using the apertures within a ground plane with a monopole antenna saves manufacturing cost and may contribute to providing a low profile for a wireless device.

An embodiment of a wireless device for transmitting a radiation signal includes a circuit board, an antenna, an aperture and a radio frequency switch. The circuit board may include a metallic ground and at least one substrate layer. The antenna may be coupled to the circuit board and transmit radio frequency (RF) signals. The aperture may be in the metallic ground plane layer and the selectable shorting device may be selectable and positioned on the metallic ground plane over the aperture. The shorting device may be selectable to reflect a radio frequency (RF) signal broadcast by the antenna.

DETAILED DESCRIPTION

An antenna apparatus may include one or more antennas coupled to a circuit board having a ground plane, such as a metallic ground plane, with one or more apertures. The apertures may be used to steer a radio frequency (RF) beam of the one or more monopole antennas. Each monopole antenna may have one or more sets of corresponding apertures. Each aperture or set of apertures may reflect and/or direct different RF signal frequencies from a single monopole antenna. A radio frequency switch such as a PIN diode switch may be positioned over the aperture and be selected to provide a short circuit at that portion of the aperture. The short circuit makes that portion of the aperture act as a ground plane with respect to the RF signal. Beam steering of an RF signal may be provided by selectively providing a short across portions of the aperture which are not to act as a reflector or director.

An aperture used for beam steering may be designed based on the wavelength of one or more RF signals transmitted by a corresponding monopole antenna. A ground plane such as a metallic ground plane may have apertures having a length, width, and a distance from the monopole based on the wavelength of the RF signal used to drive the monopole antenna. Multiple apertures may be used with a single monopole antenna to reflect different frequency RF signals. The aperture may be in any of several shapes and patterns, including slots forming circular, square, and other shapes about the footprint of the monopole antenna on a circuit board. Using the a monopole antenna with apertures to provide beam steering saves manufacturing cost and helps provide a lower profile as compared to dipole antenna-based wireless devices.

Figure 1:
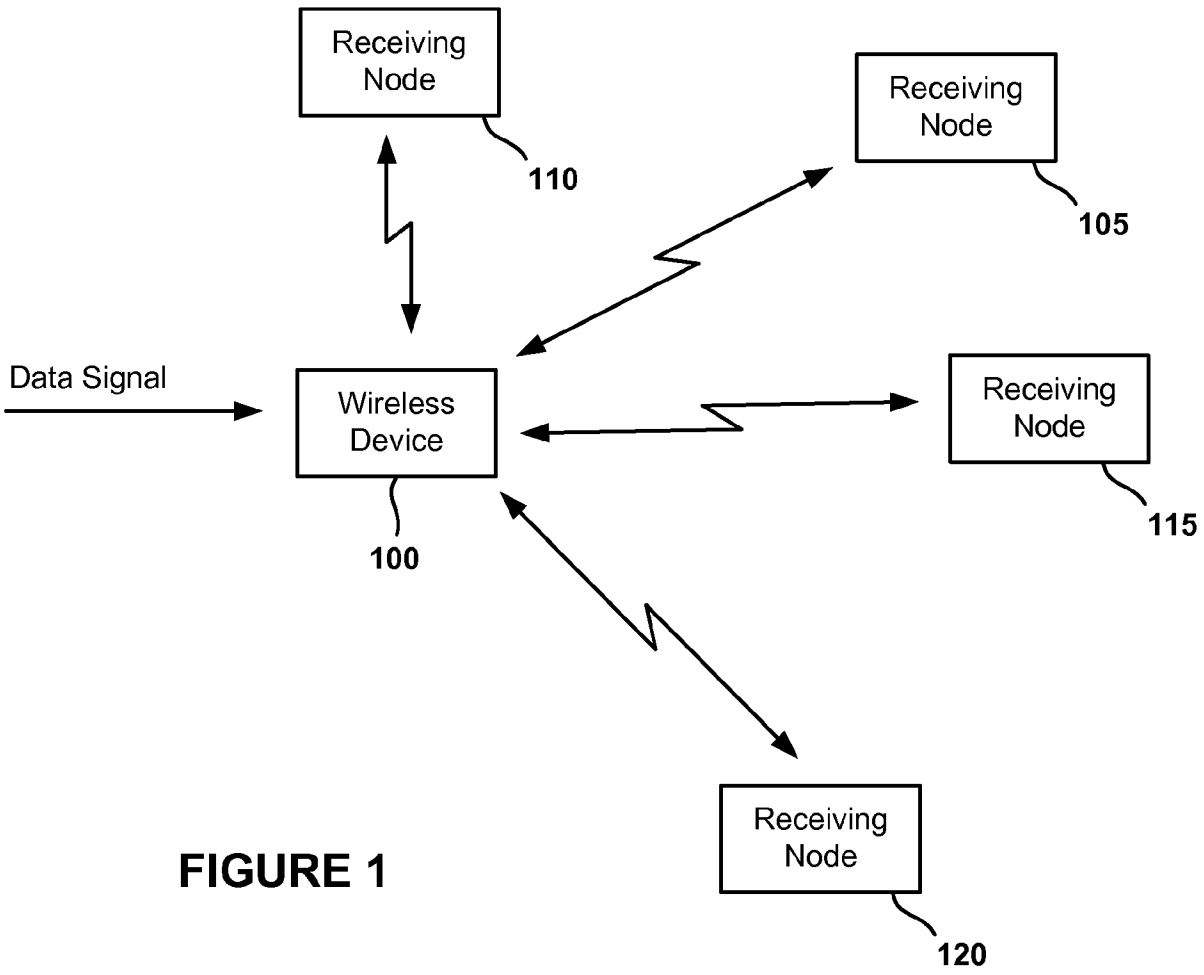
FIG. 1 is a block diagram of a wireless device in communication with one or more remote devices.
Figure 2:
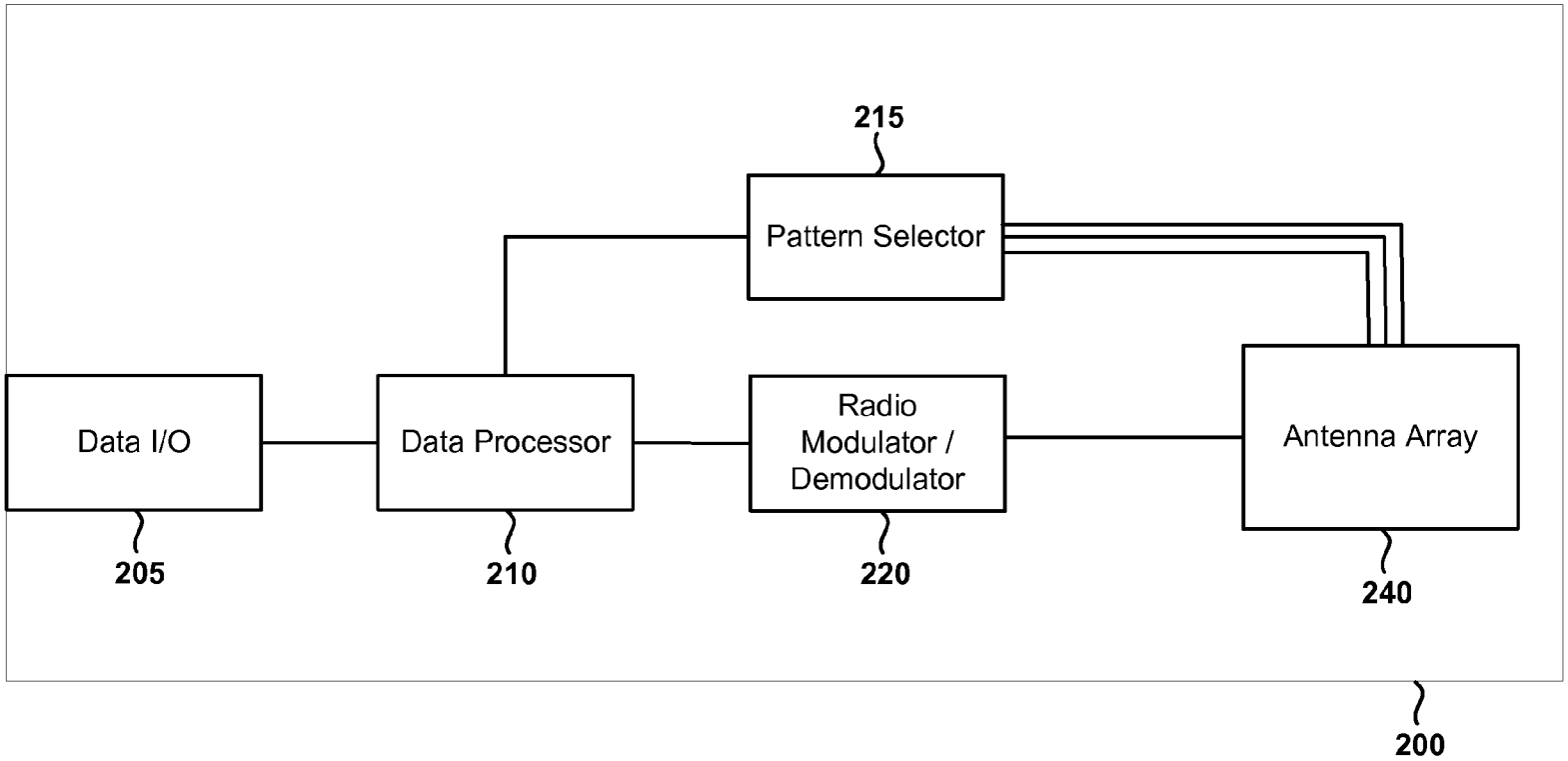
FIG. 2 is a block diagram of a wireless device.

FIG. 2 is a block diagram of a wireless device 200. The wireless device 200 of FIG. 2 can be used in a fashion similar to that of wireless device 100 as shown in and described with respect to FIG. 1. The components of wireless device 200 can be implemented on one or more circuit boards. The wireless device 200 of FIG. 2 includes a data input/output (I/O) module 205, a data processor 210, radio modulator/demodulator 220, a pattern selector 215, and antenna array 240.

The wireless device 200 of FIG. 2 may implement a MIMO system. The MIMO system may include multiple MIMO chains, wherein each chain communicates using a monopole antenna.

Radio frequency switches may be used within wireless device 200 between pattern selector and the monopole antennas of antenna array 240, such as for example to select aperture portions within a metallic ground plane. Examples of radio frequency switches are discussed with respect to FIGS. 5 and 6.

The data I/O module 205 of FIG. 2 receives a data signal from an external source such as a router. The data I/O module 205 provides the signal to wireless device circuitry for wireless transmission to a remote device (e.g., nodes 110-140 of FIG. 1). The wired data signal can be processed by data processor 210 and radio modulator/demodulator 220. The processed and modulated signal may then be transmitted via one or more antenna elements, including monopole antenna elements, within antenna array 240 as described in further detail below. The data I/O module 205 may be any combination of hardware or software operating in conjunction with hardware.

The pattern selector 215 of FIG. 2 can select one or more radio frequency switches within antenna array 240. Each radio frequency switch may be coupled across a portion of an aperture within a metallic ground plane to selectively short portions of an aperture to provide signal beam steering. Pattern selector 215 may also select one or more reflectors/directors for reflecting the signal in a desired direction. Processing of a data signal and feeding the processed signal to one or more selected antenna elements is described in detail in U.S. Pat. No. 7,193,562, entitled "Circuit Board Having a Peripheral Antenna Apparatus with Selectable Antenna Elements," the disclosure of which is incorporated by reference.

Antenna array 240 can include an antenna element array, a metallic ground plane having apertures and selectable radio frequency switches, and reflectors. The antenna element array can include one or more monopole antenna elements. Each monopole antenna element may be mounted to a circuit board and may be configured to operate at one or more particular frequencies, such as 2.4 GHz and 5.0 GHz. Antenna array 240 may also include a reflector/controller array. The mountable antenna element and reflectors can be located at various locales on the circuit board of a wireless device.

Figure 3:
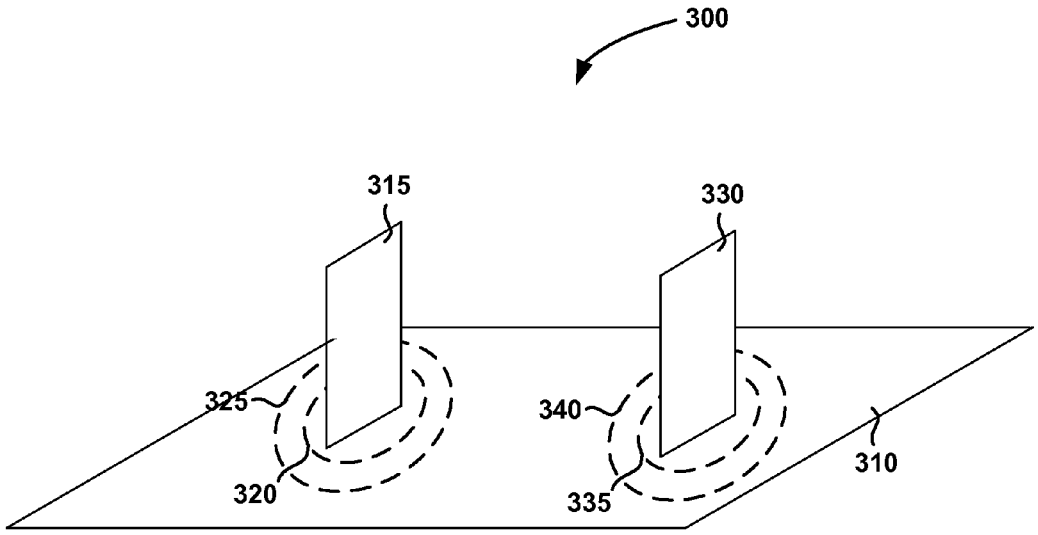
FIG. 3 illustrates a perspective view of a circuit board having monopole antennas and a metallic ground plane having apertures.

FIG. 3 illustrates a perspective view of a circuit board having monopole antennas and a ground plane having apertures. The ground plane may include a metallic ground plane. Monopole antenna elements 315 and 330 may be coupled to circuit board 310. The monopole antenna element 315 may be a quarter wavelength element and reside above a metallic ground plane within circuit board 310.

Circuit board 310 may include one or more substrate layers and ground planes. One or more of the ground planes may include one or more apertures 320, 325, 335, and 340, illustrated by dashed lines in FIG. 3. Each aperture may include a hole or opening such as a continuous slot in a ground plane of the circuit board. The aperture may be formed by any of a variety of methods, including during the manufacturing process by removing portions of the ground plane. As shown, multiple apertures may be formed for each monopole antenna element to provide beam forming for different frequencies of RF signals. For example, aperture 325 encompasses aperture 320 and aperture 340 encompasses aperture 335. Though FIG. 3 illustrates an antenna apparatus with two monopole antennas 315 and 330, more or fewer monopole antennas may be used within an antenna apparatus of the present invention.

Figure 4:
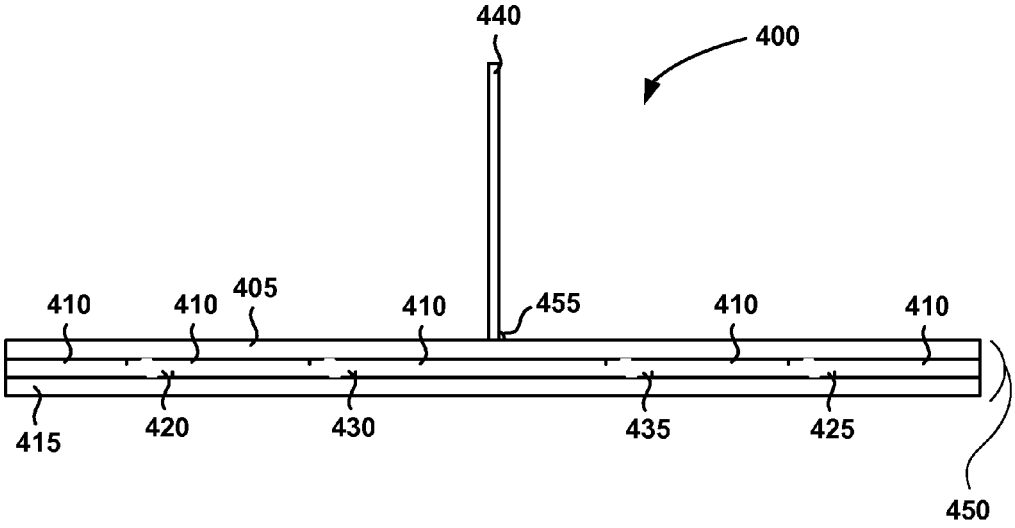
FIG. 4 illustrates a side view of a circuit board having a monopole antenna and a metallic ground plane having apertures.

FIG. 4 illustrates a side view of a circuit board 450 having a monopole antenna 440 and a ground plane having apertures. The circuit board 450 includes a top layer 405, metallic ground plane 410, and bottom layer 415. Though only three layers are shown, circuit board 450 may have more or less than the three layers illustrated in FIG. 4.

Antenna element 440 mounts to the top surface of the circuit board 450. The antenna element 440 may be inserted through slots that extend through one or more of circuit board top layer 405, ground layer 410, and bottom layer 420, or may be coupled to the surface in some other manner. The monopole antenna element 440 may be coupled to radio modulator/demodulator 220 to receive an RF signal and radiate at one or more frequencies. A portion of the monopole antenna radiation may be reflected by metallic ground plane 410. The monopole antenna element radiation and reflected radiation may combine to provide a radiation pattern similar to that provided by a dipole antenna.

Metallic ground plane 410 may include a number of apertures 420, 425, 430 and 435. The apertures are formed around monopole antenna element 440. For example, apertures 430 and 435 may be part of a single set of apertures, such as a circular or semi-circular slot, formed around monopole antenna element 440. Apertures 420 and 425 may also form an aperture around monopole antenna element 440. Apertures 430 and 435 are closer to monopole antenna element 440 and, along with one or more radio frequency switches, may direct an RF signal at a first, higher frequency while apertures 420 and 425 are positioned further away from monopole antenna element 440 and may be designed to direct, using one or more radio frequency switches, an RF signal at a second, lower frequency. The apertures closer to the monopole antenna element 440 may beam steer a higher frequency RF signal while the apertures further from the monopole antenna element 440 may beam steer a lower frequency RF signal.

To minimize or reduce the size of the monopole antenna 440, each monopole antenna element may incorporate one or more loading structures. By configuring a loading structure to slow down electrons and change the resonance of each monopole antenna element, the monopole antenna element becomes electrically shorter. In other words, at a given operating frequency, providing loading structures reduces the dimension of the monopole antenna element. Providing the loading structures for one or more of the monopole antenna element minimizes the size of the antenna element.

Circuit board 450 includes radio frequency feed port 455 selectively coupled to antenna 440. Although one antenna element is depicted in FIG. 4, more antenna elements can be implemented and selectively coupled to radio frequency feed port 455. Further, while antenna element 440 of FIG. 4 is oriented substantially in the middle of circuit board substrate, other shapes and layouts, both symmetrical and non-symmetrical, can be implemented. Radio frequency feed port 455 may be coupled to one or more monopole antenna elements to provide each monopole antenna with an RF signal The pattern selector 215 may include radio frequency switches, such as diode switches 225, 230, 235 of FIG. 2, a GaAs FET, or other RF switching devices to select one or more monopole antenna elements and/or to short portions of an aperture. A PIN diode may include a single-pole single-throw switch to switch each antenna element either on or off (i.e., couple or decouple antenna element 440 to the radio frequency feed port 310).

A series of control signals can be used to bias each PIN diode. With the PIN diode forward biased and conducting a DC current, the PIN diode switch is on, and a PIN diode placed over an aperture may provide a short across that portion of the aperture. With the diode reverse biased, the PIN diode switch is off. The PIN diodes may be placed over an aperture to provide a short at a selected portion of the aperture. In various embodiments, the radio frequency feed port 455, the pattern selector 215, and the antenna elements 440 may be close together or spread across the circuit board.

One or more light emitting diodes (LED) (not shown) can be coupled to the antenna element selector. The LEDs function as a visual indicator of which of the antenna elements 320-370 is on or off. In one embodiment, an LED is placed in circuit with the PIN diode so that the LED is lit when the corresponding antenna element is selected.

Monopole antenna element 440 can be coupled to the circuit board 450 using slots in the circuit board, coupling pads, or other coupling methods known to those skilled in the art. In some embodiments, reflectors for reflecting or directing the radiation of a mounted antenna element can also be coupled to the circuit board at one or more coupling pads. Circuit board mounting pads and coupling pad holes are described in more detail in U.S. patent application Ser. No. 12/545,758, filed on Aug. 21, 2009, and titled "Mountable Antenna Elements for Dual Band Antenna," the disclosure of which is incorporated herein by reference.

The antenna components (e.g., monopole antenna element 440) are formed from RF conductive material. For example, the monopole antenna element 440 and the ground components 410 can be formed from metal or other RF conducting material.

Externally mounted reflector/directors, if any, may further be implemented in circuit board 450 to constrain the directional radiation pattern of one or more of the antenna elements in azimuth. Other benefits with respect to selectable configurations are disclosed in U.S. patent application Ser. No. 11/041,145 filed Jan. 21, 2005 and entitled "System and Method for a Minimized Antenna Apparatus with Selectable Elements," the disclosure of which is incorporated herein by reference.

Figure 5:
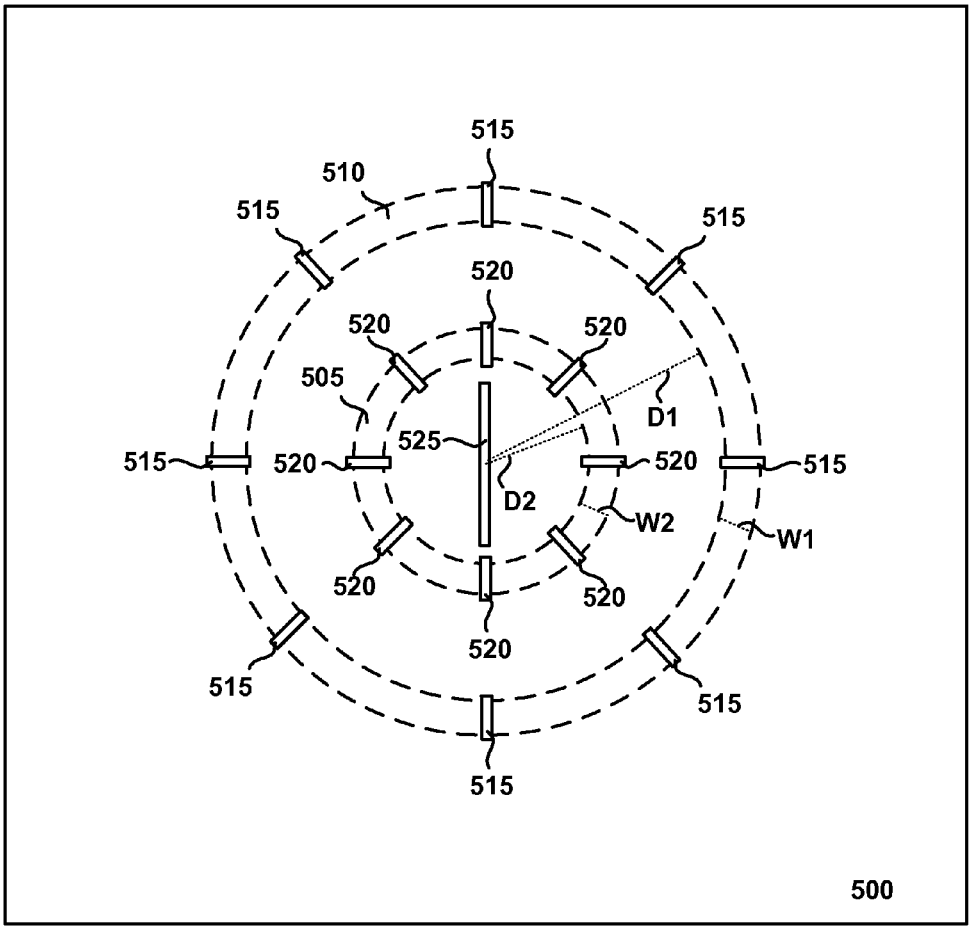
FIG. 5 illustrates a top view of a circuit board having a monopole antenna and a metallic ground plane having apertures.

FIG. 5 illustrates a top view of a circuit board having a monopole antenna and a metallic ground plane having apertures. Circuit board 500 includes apertures 505 and 510, radio frequency switches 515 and 520, and monopole antenna element 525. The circuit board 500 includes a substrate having at least first side and a second side that can be substantially parallel to the first side. The substrate may comprise, for example, a PCB such as FR4, Rogers 4003 or some other dielectric material.

Aperture 505 includes a plurality of radio frequency switches 520 placed over, across, or straddling the aperture. As an RF signal of a particular frequency is transmitted by an antennal element 525 towards the ground plane, the reflection of the RF signal induces a current in aperture 505. Aperture 505 may have a length, width and distance from the antenna based on the particular RF frequency in order for the current to be generated by the reflected RF signal. The induced current in aperture 505 causes the aperture to act as a director and/or reflector of the RF signal. Radio frequency switches placed over aperture 505 may be selected to provide a short circuit, or "short", across the aperture. Each short across portions of aperture 505 causes that portion of the aperture to no longer act as a director and/or reflector, but rather to behave as the ground plane with respect to the RF signal.

Each radio frequency switch positioned over aperture 505 may be selectively coupled to a selecting mechanism such as pattern selector 215. By selecting one or more radio frequency switches 520, the RF frequency beam provided by the monopole antennal element 525 can be steered (i.e., by portions of the slot which are not shorted) in a desired direction.

Aperture 510 is formed as a circular slot that extends around (i.e., encompasses) monopole antenna element 525. The circular aperture 510 is positioned at a distance D1 (radius of circle formed by aperture 510) from monopole antenna element 525 and has a width of W1. The length of aperture 505 is the circumference of the circular aperture, provided approximately by $2\pi r$ or $2\pi(D1)$.

Aperture 505 is formed as a circular slot that extends around monopole antenna element 525 and inside aperture 510. Aperture 505 is positioned at a distance D2 from monopole antenna element 525 and has a width of W2. The length of aperture 505 is provided approximately by 2π(D2).

The width and length of an aperture for providing beam steering as well the distance of the aperture from a monopole antenna may be determined based on the frequency of the RF signal the aperture and radio frequency switches are intended to reflect via beam steering. For example, for shorter wavelength RF signals, an aperture with short circuit causing radio frequency switches may be provided closer to a monopole antenna element. An aperture with short circuit causing radio frequency switches for beam steering larger wavelength signals may be positioned further from a monopole antenna. In some embodiments, multiple apertures for a single antenna such as a monopole antenna may be used to reflect signals of 5.0 GHz signal, 2.4 GHz signal, and other frequencies of RF signals. If aperture 510 may be used to reflect/direct a 2.4 GHz RF signal and aperture 505 may be used to direct/reflect a 5.0 GHz signal, the dimension of each aperture may be selected such that aperture 510 with radio frequency switches 515 may beam steer the 2.4 GHz signal while appearing invisible and not significantly affecting the radiation pattern of a 5.0 GHz signal. Aperture 505 with radio frequency switches 520 may beam steer the 5.0 GHz signal while appearing invisible and not significantly affecting the radiation pattern of a 2.4 GHz signal.

Figure 6:
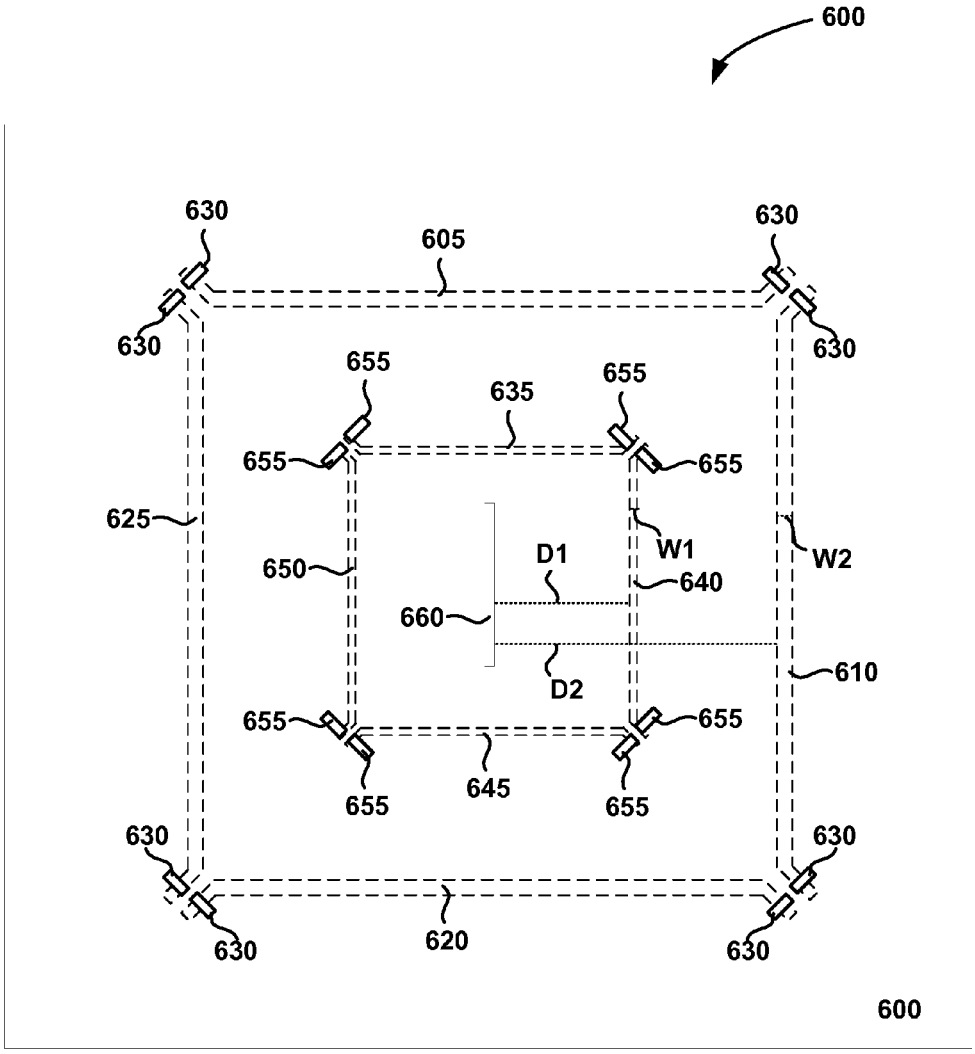
FIG. 6 illustrates a top view of another circuit board having a monopole antenna and a metallic ground plane having apertures.

FIG. 6 illustrates a top view of a circuit board having a monopole antenna and a metallic ground plane having apertures. Circuit board 600 includes apertures 605, 610, 615, and 620 forming an outer square shape aperture, apertures 635, 640, 645, and 650 forming an inner square shape aperture, radio frequency switches 630 and 655, and monopole antenna element 660. The circuit board of FIG. 6 may be similar to the circuit board of FIG. 5.

Each of apertures 605, 610, 615, and 620 is formed as a relatively straight slot with outward-bent ends and includes a radio frequency switches 655 placed at each end of each aperture. The apertures are positioned to form a square-like shape around monopole antenna 660 at distance D2 from antenna 660 and each have a width W2. The length of each aperture is approximately the length of each slot between diodes 630. Each radio frequency switches 630 may be selectively coupled to a selecting mechanism such as pattern selector 215. When one of the radio frequency switches 630 is selectively switched on, a short circuit is formed across the corresponding aperture. By selecting one or more radio frequency switches 630, the RF frequency beam provided by the monopole antennal element 660 can be steered to a desired direction, such as that associated with a receiving node.

Apertures 635, 640, 645, and 650 also form a square shape but are positioned closer to monopole antenna element 660, within the square formed by apertures 605, 610, 615 and 620. Apertures 635, 640, 645, and 650 are positioned at distance D1 from antenna 660 and each have a width W2. A selectable radio frequency switch 655 is placed at each end of each of each of apertures 635, 640, 645, and 650. Radio frequency switches 655 are placed over, across, or straddling apertures 605, 610, 615 and 620. When a radio frequency switch 655 is switched on, a short circuit is formed across the aperture. In FIG. 6, the apertures 605, 610, 615 and 620 with radio frequency switches 630 may be used to beam steer a 2.4 GHz signal while inner apertures 635, 640, 645, and 650 with radio frequency switches 655 may be used to beam steer a 5.0 GHz signal.

The embodiments disclosed herein are illustrative. Various modifications or adaptations of the structures and methods described herein may become apparent to those skilled in the art. Such modifications, adaptations, and/or variations that rely upon the teachings of the present disclosure and through which these teachings have advanced the art are considered to be within the spirit and scope of the present invention. Hence, the descriptions and drawings herein should be limited by reference to the specific limitations set forth in the claims appended hereto.

What is claimed is:

1. A wireless device for transmitting a radiation signal, comprising:

a circuit board including a metallic ground plane and at least one substrate layer;

a monopole antenna coupled to the circuit board and transmitting radio frequency (RF) signals, wherein the monopole antenna includes one or more loading structures to change a resonance of the monopole antenna; and one or more apertures in the metallic ground plane associated with the monopole antenna, wherein each of the one or more apertures has a corresponding shape and pattern, the corresponding shape and pattern being circular, elliptical, or regular polygonal, wherein at least one selectable radio frequency switch is positioned over each of the one or more apertures, and wherein the one or more apertures associated with the monopole antenna are selected based on their corresponding shape and pattern to beam steer specific RF signals transmitted from the monopole antenna via selection of associated RF switches.

2. The wireless device of claim 1, wherein the antenna is perpendicular to the circuit board.

3. The wireless device of claim 1, wherein the aperture has a length related to the RF signal wavelength.

4. The wireless device of claim 1, wherein the aperture has a width related to the RF signal wavelength.

5. The wireless device of claim 1, wherein the aperture is positioned a distance away from the antenna, the distance related to RF signal wavelength.

6. The wireless device of claim 1, wherein the metallic ground plane includes a second aperture, the second aperture having a second radio frequency switch selectable to reflect a second RF signal broadcast by the antenna, the second RF signal having a different frequency than the first RF signal.

7. The wireless device of claim 1, wherein the selectable radio frequency switch includes a PIN diode.

8. The wireless device of claim 7, wherein the radiation pattern of the antenna is controlled by selecting one or more selectable radio frequency switches.

9. The wireless device of claim 1, wherein the first aperture encompasses a second aperture within the metallic ground plane, the second aperture and a second radio frequency switch causing reflection of an RF signal by the metallic ground plane, the second RF signal having a higher frequency than the RF signal reflected by the metallic ground plane near the first aperture.

10. The wireless device of claim 1, wherein the aperture is formed by a single opening in the metallic ground plane.

11. The wireless device of claim 1, wherein the aperture is formed by a plurality of openings in the metallic ground plane.

12. The wireless device of claim 1, wherein the one or more apertures associated with the monopole antenna include slots forming a variety of shapes about a footprint of the monopole antenna on the circuit board.

* * * * *